United States Patent [19]

Gruy

[11] 3,942,204

[45] Mar. 9, 1976

[54] SWIVEL ARRANGEMENT FOR SINGLE ANCHOR LEG MOORING BUOY

[75] Inventor: Robert H. Gruy, Houston, Tex.

[73] Assignee: Sofec, Inc., Houston, Tex.

[22] Filed: Jan. 13, 1975

[21] Appl. No.: 540,551

[52] U.S. Cl. ..... 9/8 P; 114/230; 141/100; 141/387

[51] Int. Cl.[2] ..... B65B 3/04

[58] Field of Search ..... 9/8 P; 141/387, 388, 382, 141/284, 279, 100; 114/230; 285/131, 136, 190, DIG. 5, 134, 95, 96, 97; 137/236; 277/27

[56] References Cited

UNITED STATES PATENTS

| | | | |
|---|---|---|---|
| 2,648,554 | 8/1953 | Gilbert | 285/97 |
| 3,333,870 | 8/1967 | Watkins | 285/96 |
| 3,727,652 | 4/1973 | Reynolds | 141/387 |
| 3,735,435 | 5/1973 | Mikulicic et al. | 9/8 P |
| 3,838,718 | 10/1974 | Flory et al. | 9/8 P |
| 3,840,927 | 10/1974 | Reid, Jr. | 9/8 P |
| 3,874,706 | 4/1975 | Arnold | 285/96 |

*Primary Examiner*—Trygve M. Blix
*Assistant Examiner*—Charles E. Frankfort
*Attorney, Agent, or Firm*—Bertram H. Mann

[57] ABSTRACT

A single anchor leg type single point mooring and cargo transfer buoy has a load-carrying central shaft pipe for anchoring on the sea bottom and having a plurality of structurally segregated transfer chambers about which rotatable housings are sealingly mounted. Cargo vessel piping connects with these rotatable housings which communicate with the sea floor piping through connections extending longitudinally through the central shaft pipe and through apertures in the central shaft pipe wall.

5 Claims, 4 Drawing Figures

SWIVEL ARRANGEMENT FOR SINGLE ANCHOR LEG MOORING BUOY

BACKGROUND OF THE INVENTION

This invention relates to single point mooring devices for offshore mooring of cargo vessels and transfer of cargo to and from the vessels and consists particularly in novel means for transferring multiple fluids while eliminating any possibility of cross-leakage of the fluids.

Single mooring point buoys heretofore devised have generally embodied sealed swivel joints located in such positions that extremely undesirable cross-leakage between the fluids may result in case of leakage in the swivel joints. Furthermore, such equipment, generally, has been of the catenary anchor chain type in which the sealed swivels are carried by the floating elements of the buoy and do not carry heavy loads.

SUMMARY OF THE PRESENT INVENTION

Accordingly, it is an object of the present invention to provide a single point mooring apparatus of the single anchor leg type in which the fluid line swivel connections are incorporated in a rugged base structure anchored to the sea floor and in which danger of cross-leakage of the fluids, even in the case of failure of a swivel packing, is avoided.

Another object is to provide novel emergency sealing means for a swivel joint of the above type.

In accordance with the present invention a load-carrying central pipe shaft projects upwardly from rugged base structure anchored to the sea floor. A transfer chamber near the upper end of this pipe shaft is closed by a structural top wall and the side wall of the transfer chamber has one or more apertures for communicating the transfer chamber with the interior of an annular housing rotatably and sealingly mounted about the transfer chamber. A second transfer chamber is mounted on the upper end of the load-carrying central pipe shaft and is sealed from the first transfer chamber by the mentioned structural top wall. The second transfer chamber has one or more apertures in its side wall communicating with a second housing rotatably and sealingly mounted abreast of the second transfer chamber.

Cargo fluid connections with pipes leading to the vessel extend through the load-carrying central pipe shaft into the first and second transfer chambers.

BRIEF DESCRIPTION OF THE DRAWINGS

In the accompanying drawings.

DESCRIPTION OF THE PREFERRED EMBODIMENT

The buoy consists in general of rugged base structure generally designated A with upstanding, central swivel assembly B and an upper float part C connected to the base structure by a chain D. The float part C incorporates a mooring bracket 6 for connection to the mooring line 6*a* leading to the vessel being serviced. Any suitable float construction C may be utilized, since the details of this construction, in themselves, do not constitute the present invention. Chain D is connected to the base structure through a swivel E.

Figures 1, 2:
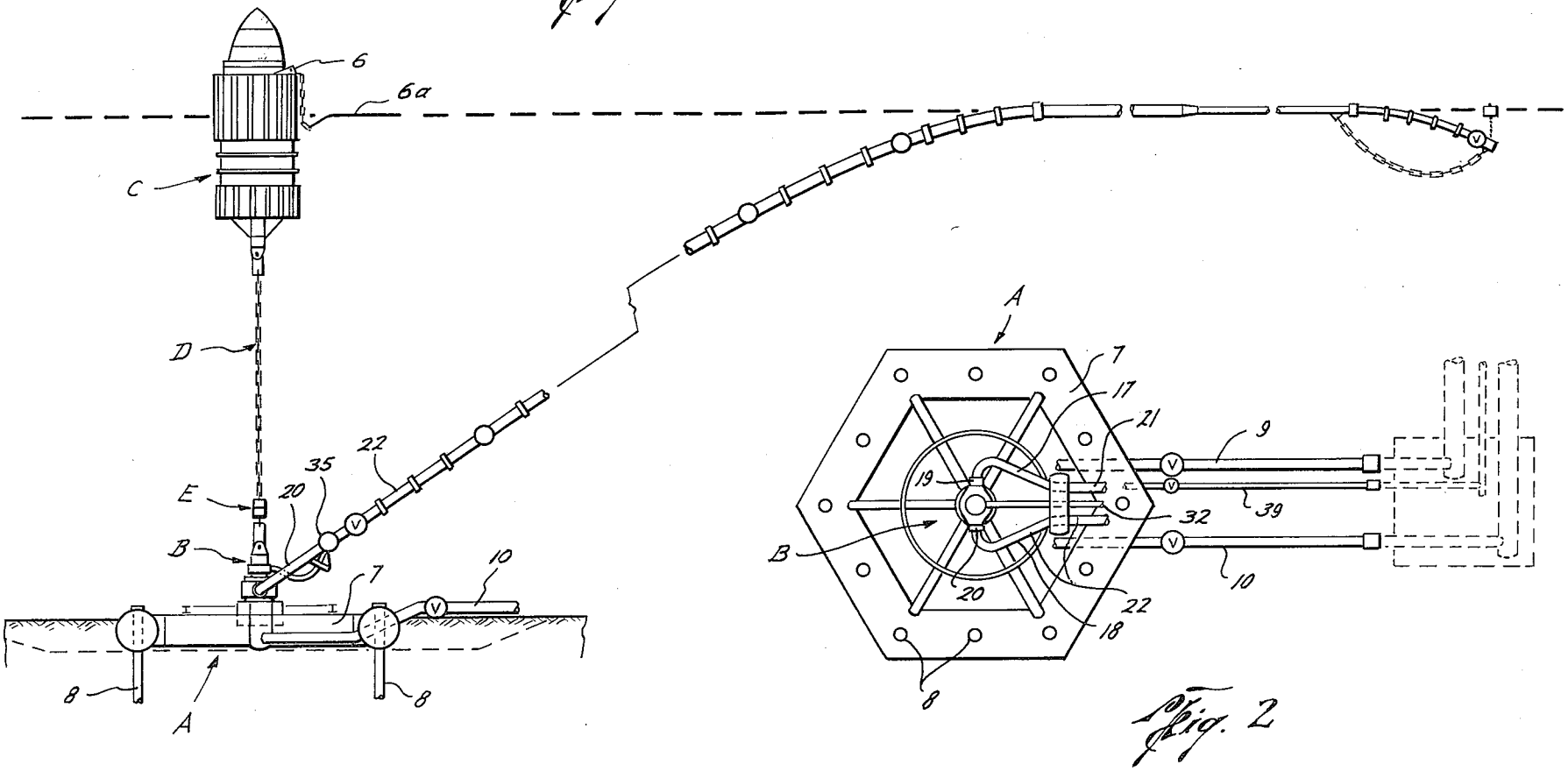
FIG. 1 is an elevation of a single anchor leg type of mooring buoy embodying the invention.
FIG. 2 is a plan view showing the base portion of the buoy.
Figure 3:
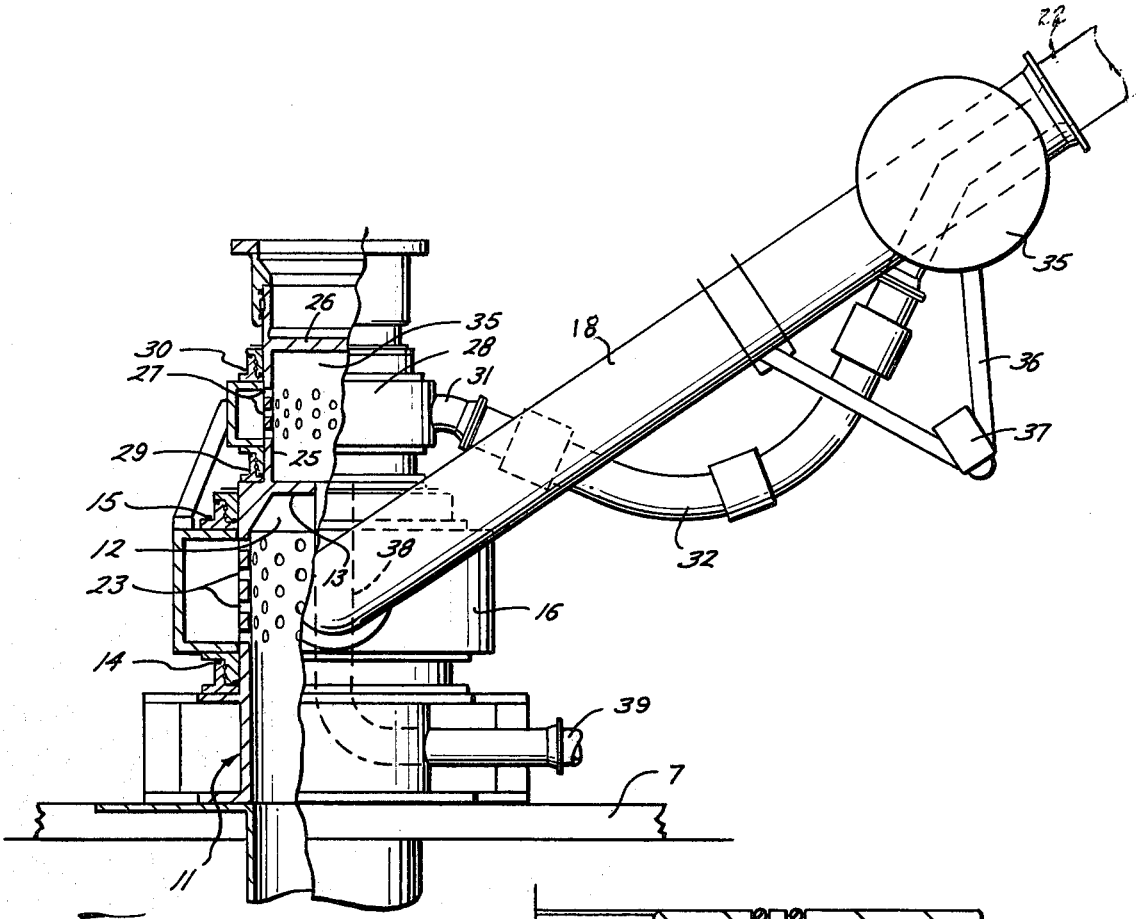
FIG. 3 is in part an enlarged side elevation and in part a vertical transverse section on the longitudinal center line of the base structure.

The base structure A, B, as best shown in FIG. 3, includes the sufficiently wide and rugged base plate construction 7 resting on and secured to the seal floor, as by means of pilings 8 (FIG. 1). Primary fluid pipes 9 and 10 on the sea floor connect with the bottom of the rugged, upstanding, load-carrying central shaft-pipe 11 which extends through and is rigidly secured to base plate construction 7. Near the upper extremity of shaft-pipe 11, there is a transfer chamber 12, forming a part of the interior of shaft-pipe 11 and closed at the top by a structural wall 13. Rotatably received about the upper portion of shaft-pipe 11, by means of longitudinally spaced, sealing swivel joints 14 and 15, is the chambered housing 16. As indicated in FIG. 2, a pair of hose arms 17 and 18 project diametrically oppositely from housing 16, being connected thereto by swivel joints, generally designated 19 and 20, for coupling to the pair of main cargo pipes 21 and 22 leading to the vessel being serviced. A plurality of apertures 23 in the side wall of transfer chamber 12 provide communication between the transfer chamber and the interior of rotatable housing 16.

Mounted above structural top wall 13 of shaft-pipe 11 and rigid therewith is a relatively short, cylindrical structure 25 forming the upper transfer chamber 35 which is closed at the top by an integral transverse wall 26, the side wall of structure 25 having a plurality of apertures 27 for communcation with the interior of a second housing 28 rotatably and sealingly mounted on structure 25 by swivel joints 29 and 30. Housing 28 has a lateral nipple 31 for connection to the secondary fluid pipe or hose 32 leading to the cargo vessel.

All of the cargo pipes or hoses 21, 22 and 32 leading to the vessel are shown as supported by a buoyancy tank 35 from which depends the triangular structure 36 supporting the stabilizing ballast 37, as disclosed and claimed in a copending application, Ser. No. 424,958 filed Dec. 17, 1973, by Kristen I. Pedersen and assigned to the assignee of the present invention now U.S. Pat. No. 3,883,912. The upper transfer chamber 35 communicates through a central downward pipe 38 with a secondary fluid pipe 39 leading along the seabed to the shore or other terminal.

Figure 4:
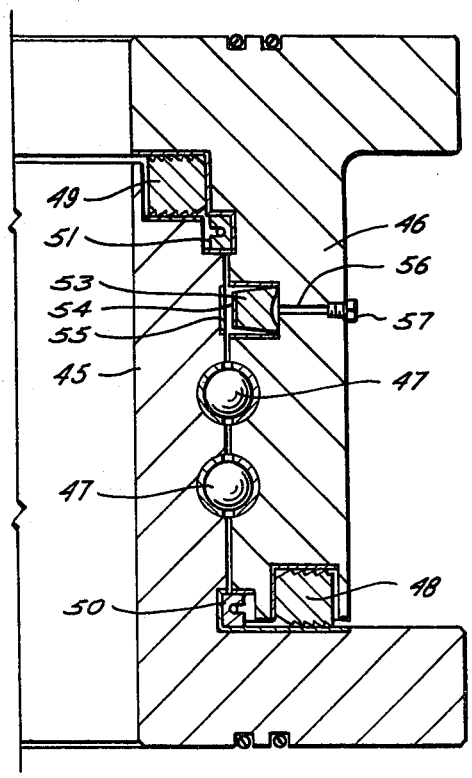
FIG. 4 is a still further enlarged vertical transverse section of one of the sealing swivel joints.

FIG. 4 illustrates in detail one of the swivel seal joints in enlarged transverse section. The joint includes the inner body 45 which securely engages the load-carrying central shaft structure 16 and outer body part 46 which rotates on ball bearings 47 and is secured to one of the chambered housings 16 and 28. Primary and secondary seals are provided at 48, 49, 50, and 51, which, when in normal working order, prevent the escape of cargo fluid or the leakage of water into the transfer or rotary chambers. All of the above is more or less conventional and commercially obtainable. Of especial significance is the emergency seal ring 53 interposed between the uppermost ball bearings 47 and the adjacent secondary seal 51. The emergency seal, conveniently, is made primarily of synthetic rubber, as "Buna-N", with the Teflon face 54 for bearing against the lined seal area 55, for instance, of Monel. Emergency seal 53, etc., is normally retracted, as shown in FIG. 4. However, actuating fluid may be applied to the cupped rear face of emergency seal 53 through a short cross bore 56 with connection fitting 57 for strongly actuating the emergency seal against opposing swivel body 45 to effectively prevent any leakage along the interface between swivel body parts 45 and 46. Such actuation of the emergency seal may be manually initiated from the surface.

OPERATION

With base construction 7 firmly secured to the seabed and float portion C anchored thereto by the chain D, a vessel to be loaded or unloaded will be secured by the mooring line *6a* to mooring bracket 6. The entire float C is free to rotate relative to structures A and B to permit swinging of the vessel about the buoy under the influence of wind, wave, and current action. Fluid unloading or loading hoses 21 and 22, for instance for the main fluid cargo, are then connected to hose arms 17 and 18; and hose 32, for instance, for a different fluid, such as bunker fuel, is connected to nipple 31. Since hose arms 17 and 18 and nipple 31 are mounted, respectively, on rotatable housings 16 and 28, these mountings, normally, will remain fluid-tight and interference between the hoses and the buoy will be avoided during swinging of the vessel about the buoy. While connections for only two different fluids are shown, any number of different fluids may be handled by a buoy embodying the principles of the present invention simply by duplicating the supplementary and structurally separate transfer chambers and associated rotatable housings, as 25, 28, on top thereof with corresponding sealed and rotatably mounted housings for connection to the additional hose lines leading to the vessel.

In the present instance, cargo lines 21 and 22 from the vessel connect through the main load-carrying shaft-pipe 11 with a pipe or pipes 9 and 10 leading along the seabed to the shore or other terminal. Secondary line 39 connects with the angled pipe 38 which extends securely and sealingly through the wall of shaft-pipe 11, thence turns upwardly, passing concentrically through first transfer chamber 12 and its structural top wall 13 into upper transfer chamber 35. Where other vessel hose lines are to be accommodated, the additional seabed connections may extend along or through shaft-pipe wall 11 concentrically through the intervening surmounted transfer chambers and their structural top walls.

Of particular significance is the fact that transfer chambers 12, 35 and their corresponding rotary housings 16 and 28 and the swivel seal joints for the respective housings are spaced apart and fully and structurally segregated so that the continuing efficacy of the swivel seals need not be relied upon to prevent cross-leakage of the different fluids being handled. Any leakage through the swivel joints will pass into the surrounding water and not contaminate the transported fluids. The invention may be modified in various respects as will occur to those skilled in the art, and the exclusive use of all modifications as come within the scope of the appended claims is contemplated.

I claim:

1. In a mooring buoy, a base structure having a plurality of transfer chambers including first conduits communicating, respectively, therewith, means for anchoring said base structure to a marine bottom, spaced-apart chambered housings separately mounted on said base structure each abreast of and communicating with a different one of said transfer chambers so that leakage from one housing can not contaminate any other housing, sealed swivel joints rotatably mounting each of said housings on said base structure, and other conduits connected, respectively, with each of said housings, said base structure including integral wall means segregating said transfer chambers, and said swivel joints for each of said housings being spaced from the other housings and the sealed swivel joints therefor so as to preclude any cross leakage between said housings in case of leakage in any of said sealed swivel joints.

2. The combination described in claim 1 in which said base structure comprises a load-carrying central shaft and said housings rotate thereabout.

3. The combination described in claim 2 in which said first conduits extend along said base structure and said transfer chambers are formed serially therealong.

4. The combination described in claim 3 in which there are two first conduits one of said first conduits extending longitudinally through the other, said wall means being a transverse wall separating two of said transfer chambers, the inner one of said first conduits opening through said transverse wall to communicate with one of said transfer chambers while the other of said first conduits communicates with the other one of said transfer chambers.

5. A single anchor leg mooring buoy comprising a base member for anchoring on a marine bottom and a hollow, load-carrying, central shaft-pipe structure projecting upwardly therefrom and forming a first transfer chamber with an integral top closure wall, a first conduit communicating through said shaft-pipe structure with said first transfer chamber, a first housing rotatably mounted about said shaft-pipe structure abreast of said first transfer chamber, an aperture in a wall of said first transfer chamber providing fluid communication between said first transfer chamber and said first housing, a second conduit connected to said first housing, a second transfer chamber in said shaft pipe structure above said top closure wall and fluidly sealed from said first transfer chamber by said top closure wall, a second housing separated from said first housing so as to preclude leakage from said second housing into said first housing, said second housing being separately, rotatably mounted about said shaft-pipe structure and abreast of said second transfer chamber, an aperture in a wall of said second transfer chamber providing fluid communication with said second housing, swivel seals respectively mounting each of said housings on said shaft-pipe structure at separated locations, a third conduit extending through said shaft-pipe structure and said top closure wall into said second transfer chamber, and a fourth conduit in fluid communication with said second housing, said swivel seals for each of said housings being spaced from the other housing and its swivel seals to preclude any cross leakage between said first and second housings in case of leakage in any of said seals.

* * * * *